United States Patent [19]

Land

[11] 3,996,050

[45] Dec. 7, 1976

[54] WHITENING AGENTS IN COLOR DIFFUSION TRANSFER FILM UNITS

[75] Inventor: Edwin H. Land, Cambridge, Mass.

[73] Assignee: Polaroid Corporation, Cambridge, Mass.

[22] Filed: Dec. 26, 1974

[21] Appl. No.: 536,434

Related U.S. Application Data

[63] Continuation-in-part of Ser. No. 463,264, April 23, 1974, abandoned.

[52] U.S. Cl. ..... 96/3; 96/29 D; 96/73; 96/74; 96/77; 96/84 R

[51] Int. Cl.[2] ..... G03C 7/00; G03C 1/40; G03C 1/84; G03C 5/54

[58] Field of Search ..... 96/3, 29 D, 77, 84 R, 96/73, 74

[56] References Cited

UNITED STATES PATENTS

| | | | |
|---|---|---|---|
| 3,269,840 | 8/1966 | Pattyn et al. | 96/82 |
| 3,592,645 | 7/1971 | Weyerts et al. | 96/3 |
| 3,743,531 | 7/1973 | Ducharme | 96/77 |
| 3,802,881 | 4/1974 | Land et al. | 96/84 R |

*Primary Examiner*—David Klein
*Assistant Examiner*—Richard L. Schilling
*Attorney, Agent, or Firm*—Sybil A. Campbell

[57] ABSTRACT

This invention relates to photographic film structures for forming color transfer images viewable by reflected light without separation of the photosensitive and image-receiving components and to diffusion transfer processes employing these unitary film units wherein a dye is initially positioned in the image-receiving component to offset the color stain that tends to form in the highlights of the transfer image during aging. Any dye or mixture of dyes may be employed which are capable of absorbing visible light in a wavelength range complementary to the wavelength range absorbed by the color stain and are used in a concentration such that the highlights, i.e., $D_{min}$ areas of the transfer image, appear substantially white after aging, as observed by the eye. In a preferred embodiment, the dye employed is a dye developer.

41 Claims, 2 Drawing Figures

WHITENING AGENTS IN COLOR DIFFUSION TRANSFER FILM UNITS

CROSS-REFERENCE TO RELATED APPLICATION

This application is a continuation-in-part of copending application Ser. No. 463,264 filed Apr. 23, 1974, now abandoned.

BACKGROUND OF THE INVENTION

1. Field of the Invention

The present invention is concerned with photography, and more particularly, with the formation of color diffusion transfer images having whiter highlights.

2. Description of the Prior Art

A number of diffusion transfer photographic processes have been proposed wherein the resulting photograph comprises the developed silver halide emulsions retained with the dye image-carrying layer as part of a permanent laminate. The image-carrying layer is separated from the developed silver halide emulsions in said laminate by a light-reflecting layer, preferably a layer containing titanium dioxide. Illustrative of patents describing such products and processes are U.S. Pat. No. 2,983,606 issued Mar. 9, 1961 to Howard G. Rogers, U.S. Pat. Nos. 3,415,644; 3,415,645; and 3,415,646 issued Dec. 10, 1968 to Edwin H. Land, U.S. Pat. Nos. 3,594,164 and 3,594,165 issued July 20, 1971 to Howard G. Rogers, and U.S. Pat. No. 3,647,347 issued Mar. 7, 1972 to Edwin H. Land.

Referring more specifically to aforementioned U.S. Pat. No. 3,415,644, this patent disclosed photographic products and processes employing dye developers wherein a photosensitive element and an image-receiving layer are maintained in fixed relationship prior to photoexposure and this fixed relationship is maintained after processing and image formation to provide a laminate including the processed silver halide emulsions and the image-receiving layer. Photoexposure is made through a transparent (support) element and application of a processing composition provides a layer of light-reflecting material to provide a white background for viewing the image and to mask the developed silver halide emulsions. The desired color transfer image is viewed through said transparent support against said white background.

In the utilization of unitary film structures such as these, it has been observed that color stain tends to build up in the image highlight areas in time. Perhaps the most commonly employed means for counteracting color stain in photographic products is the use of fluorescent dyes as optical brighteners. For example, U.S. Pat. No. 3,269,840 discloses a photographic material comprising a support carrying a baryta layer employing gelatin as the essential binder and having a water-soluble optical brightener and a water-soluble vinyl polymer incorporated therein. U.S. Pat. No. 3,743,531 discloses photographic material which includes a support, a substantially protein-free layer containing baryta, polyvinyl alcohol and an optical brightener carried on the support and optionally, a polymeric layer overcoated on the baryta layer. This photographic element additionally may include a blue pigment or a mixture of blue and magenta pigments in the baryta layer as a tint.

Though the use of certain binders for the baryta layer, such as polyvinyl alcohol, has improved the stability of the optical brightener to decomposition and loss of fluorescence, fluorescent dyes are subject to further disadvantages. Because they depend upon irradiation with ultraviolet light for emitting visible light, their efficiency is reduced when used in conjunction with conventional UV absorbers and their visual effectiveness differs according to the light, i.e., natural or artificial illumination used for viewing the photographic image.

One method of enhancing the whiteness of the non-image or highlight areas of color reflection prints without the use of fluorescent materials forms the subject matter of U.S. Pat. No. 3,802,881 issued Apr. 9, 1974 to Edwin H. Land and Stanley M. Bloom. As disclosed therein, a "non-fluorescent optical whitening reagent" is employed in association with the transfer image to balance the color stain, i.e., a non-fluorescent reagent which has a color complementary to that of the stain such that the combination of reagent color plus stain color reflects substantially white light. As discussed therein, the whitening reagent may be a pigment or a dye, and initially may be positioned in the processing composition or in a layer of the film unit provided that it does not absorb actinic radiation intended to expose the photosensitive strata and subsequent to processing, should be positioned in the light-reflecting layer and/or in a layer of layers of the image-receiving component.

The present invention also is concerned with the use of a non-fluorescent optical whitening reagent for enhancing the whiteness of the non-image areas of color reflection prints, but as used herein, the whitening reagent is initially positioned in the image-receiving component and is retained therein subsequent to processing.

Though U.S. Pat. No. 3,671,241 discloses the use of small quantities of a blue or purple dye in image-receiving elements employed in diffusion transfer processes, it is concerned with the formation of silver rather than color transfer images. The image-receiving layer employed in the subject patent does not contain a dye mordant as used in color diffusion transfer processes but comprises a stratum of a silver precipitating agent.

SUMMARY OF THE INVENTION

It is, therefore, the primary object of the present invention to provide diffusion transfer photographic products and processes of the foregoing description adapted to produce color reflection prints possessing a white background and whiter highlights.

Other objects of this invention will in part be obvious and will in part appear hereinafter.

The invention accordingly comprises the processes involving the several steps and the relation and order of one or more of such steps with respect to each of the others, and the products and compositions possessing the features, properties and the relation of elements which are exemplified in the following detailed disclosure, and the scope of the application of which will be indicated in the claims.

For a fuller understanding of the nature and objects of the invention, reference should be had to the following detailed description of the invention taken in conjunction with the accompanying drawings.

DESCRIPTION OF THE PREFERRED EMBODIMENTS

Figure 1:
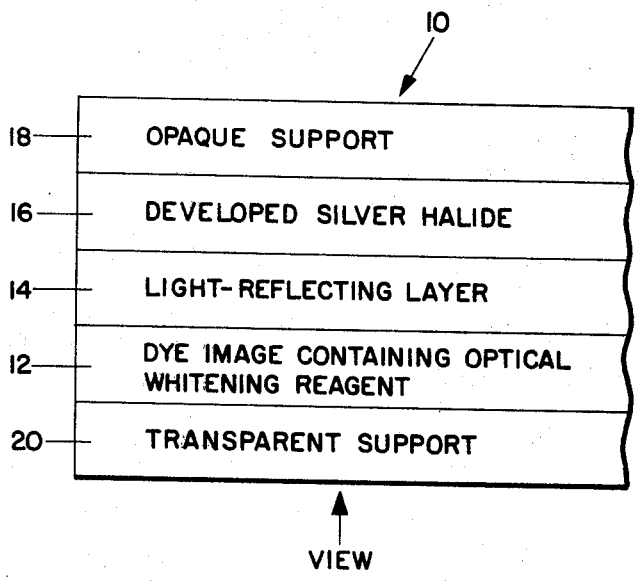
FIG. 1 is a diagrammatic enlarged schematic illustration of a diffusion transfer dye image formed in accordance with one embodiment of this invention.

As noted above, this invention is concerned with diffusion transfer processes wherein the layer containing the diffusion transfer dye image, i.e., the image-receiving layer, is not separated from the developed photosensitive layers after processing but both components are retained together as part of a permanent laminate. Film units particularly adapted to provide such diffusion transfer images have frequently been referred to as "integral negative-positive" film units. The resulting image may be referred to as an "integral negative-positive reflection print" and as so used is intended to refer to a reflection print wherein the developed photosensitive layers have not been separated from the image layer, i.e., the layer containing the transfer dye image. A light-reflecting layer between the developed photosensitive layer(s) and the image layer provides a white background for the dye image and masks the developed photosensitive layer(s). These layers are part of a permanent laminate which usually includes dimensionally stable outer or support layers, the transfer dye image being viewable through one of said supports.

These film units optionally may contain other layers capable of performing specific desired functions. For example, where dye developers are employed as the dye image-providing material, it is desirable to adjust the alkalinity of the dye developer environment in the image-receiving layer following substantial transfer of the dye image-providing material. Usually, the pH is reduced to a level at least substantially precluding alkaline oxidation of the developing radical in order to increase the light stability of the color transfer image and to render the dye developer substantially non-diffusible. The desired pH reduction may be effected by including, preferably in the image-receiving component of the film unit, a neutralizing layer comprising an acid-reacting reagent such as a polymeric acid layer as described in U.S. Pat. No. 3,362,819.

As noted previously, it has been observed that the "whites", i.e., the image highlight areas of reflection prints produced with unitary film structures of the type described above, tend to discolor in time. The background and highlight areas of the transfer image have a tendency to appear yellow upon aging. The present invention is concerned with an improvement in the use of non-fluorescent optical whitening reagents for preventing or at least minimizing the appearance of color stain.

It has now been found that in these unitary film structures, the optical whitening reagent in the amount necessary to balance the color stain may be located in the photoexposure optical path without being rendered nonabsorbing to actinic radiation intended to expose the photosensitive strata. For example, in the film units where both photoexposure and viewing of the color transfer image is made through the transparent support of the image-receiving component, the color needed to correct color stain build-up may be incorporated in the image-receiving component before photoexposure and processing.

Heretofore, the incorporation of colored materials in photographic film units for forming multicolor images as described in U.S. Pat. No. 3,547,640, has been for a different purpose, namely, to substantially eliminate any image dye deficiency in minimum density areas of the color image. For example, where it has been determined that there is a deficiency of an image-forming dye in a color negative, a colored material having its maximum wavelength absorption at substantially the same wavelength as the maximum light absorption of said image dye is incorporated in the support or other layer of the negative in the amount needed to correct the deficiency. In contrast, the subject invention is concerned with balancing color occurring as an after-effect, not with compensating for a pre-existing color deficiency. Indeed, experimental evidence has shown that little, if any, of the yellow stain build-up in the highlight areas of the transfer image is attributable to the yellow image-forming dye.

In carrying out the present invention, the optical whitening reagent is initially positioned in the image-receiving component. It may be included in the dyeable polymeric layer, the neutralizing layer and/or in any other layer carried on the support and should be uniformly distributed in said layer or layers, i.e., distributed in a non-imagewise fashion therein.

The optical whitening reagent selected to correct the color stain should have a color complementary to the color of the stain and should be employed in a quantity such that the color added will balance the color of the stain. Stated another way, the optical whitening reagent employed should be capable of absorbing visible radiation within a predetermined wavelength range complementary to the wavelength range absorbed by the color stain and should be added in a concentration such that the light reflected from the highlights, i.e., the $D_{min}$ areas of the transfer image after aging appears to be substantially white, as observed by the eye. Besides the requisite color characteristics, the whitening reagent should be substantially non-diffusible from the image-receiving component, e.g., by being insoluble in the processing composition or by being mordantable in the image-receiving layer if it is diffusible so that it is retained in the image-receiving component.

Though any pigment or dye may be employed as the optical whitening reagent, the use of dye developers has been found particularly satisfactory because they are readily retained in the image-receiving component by mordanting to the dye image-receiving layer and/or by immobilization in the neutralizing layer. Indeed, in a particularly preferred embodiment of the present invention, dye developer(s) are incorporated as the optical whitening reagent in the neutralizing layer because of their stability to oxidation and relative non-diffusibility in the environment provided by the acid-reacting reagent.

Dye developers are well known in the art and any of those conventionally used as dye image-forming materials may be employed in the present invention. These compounds contain, in the same molecule, both the chromophoric system of a dye and also a silver halide developing function. By "a silver halide developing function" is meant a grouping adapted to develop exposed silver halide. A preferred silver halide development function is a hydroquinonyl group. Other suitable developing functions include ortho-dihydroxyphenyl and ortho and para-amino substituted hydroxyphenyl groups. In general, the development function includes a benzenoid developing function, that is, an aromatic developing group which forms quinonoid or quinone substances when oxidized.

Examples of dye developers suitable for use as optical whitening reagents in the present invention include those disclosed in U.S. Pat. Nos. 3,076,808; 3,076,820; 3,134,762; 3,134,763; 3,134,764; 3,134,765; 3,135,734; 3,173,906; 3,186,982; 3,201,384; 3,208,991; 3,209,016; 3,218,312 3,236,864; 3,236,865; 3,246,016; 3,252,969; 3,253,001; 3,255,206; 3,262,924; 3,275,617; 3,282,913; 3,288,778; 3,299,041; 3,303,183; 3,306,891; 3,337,524; 3,337,589; 3,357,969; 3,365,441; 3,424,742; 3,482,972; 3,491,127; 3,544,545; 3,551,406; 3,597,200; and 3,752,836.

Though dye developers represent the preferred class of optical whitening reagents, other whitening reagents having the necessary color characteristics may be selected from pigments and from dyes that do not contain a silver halide developing function, e.g., phthalocyanine, arylmethane, anthraquinone, indigoid, indanthrone, methine, azomethine, quinoline, azo and any of the various other classes of pigments and dyes known in the art. If desired, a combination of pigments and/or dyes including dye developers may be used for obtaining the appropriate color characteristics needed for absorbing light in the wavelength range complementary to the wavelength range absorbed by the color stain.

It will be appreciated that the optical whitening reagent(s) selected should be stable in the photographic system under the processing conditions encountered and should be stable to prolonged exposure to light.

The appropriate amount of whitening reagent may be readily determined empirically for a given photographic system by measuring the minimum transfer reflection densities for red, green and blue light initially and again after prolonged standing at room temperature or after accelerated aging at elevated temperatures and then adding the whitening reagent or mixture of whitening reagents having the requisite light absorption characteristics in an amount that will maintain the difference between the minimum densities after aging within a range such that the light reflected from the highlights appears substantially white to the viewer.

As an illustration, in photographic systems employing composite film units of the type disclosed in aforementioned U.S. Pat. No. 3,415,644, it has been observed that the minimum transfer reflection density for blue light increases upon aging, the density for red light decreased and that the density for green light remains about the same. (The minimum transfer reflection density measurements initially and after aging were referenced against magnesium carbonate as 0.00). In such film units, the adjustment in the minimum transfer reflection densities to the ranges discussed above may be achieved by including as the optical whitening reagent, a cyan dye developer or a mixture of cyan and magenta dye developers in a substantially uniform distribution in a layer or layers of the image-receiving component. Though not essential, the selection of dye developer(s) that are soluble in the solvent used in preparing the particular layer allows greater ease in obtaining the uniform, non-imagewise dispersion of dye developer in the small quantities needed. For example, in the preferred embodiment where the dye developer(s) are incorporated in the neutralizing layer, the dye developer(s) selected preferably are soluble in the solvent used for dissolving the acid-reacting reagent and thus are present in the resulting neutralizing layer as a molecular dispersion.

Figure 2:
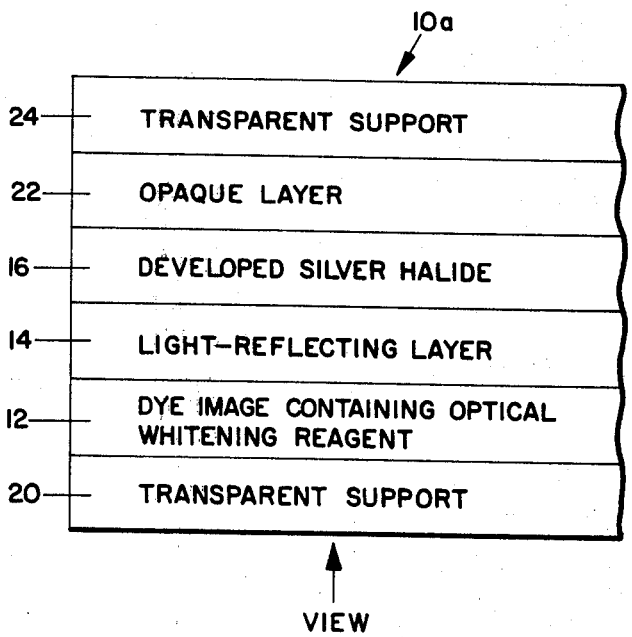
FIG. 2 is a similar schematic illustration of a diffusion transfer dye image formed in accordance with another embodiment of this invention.

FIGS. 1 and 2 illustrate in a simplified or schematic form the arrangement of layers in photographic films of the type with which this invention is concerned, the film or film unit being depicted as an integral laminate after processing and image formation. Since the two film units shown have many elements in common, the two Figures will be described together. As will be evident from the Figures, a diffusion transfer image in an image-receiving or image-carrying component 12 is viewed through a transparent support 20 against a light-reflecting layer 14 which in turn masks the developed silver halide emulsions(s) 16. In accordance with this invention, an optical whitening reagent(s) having the requisite spectral absorption characteristics is positioned in the dye image layer or in another layer of the image-receiving component 12 between the transparent support 20 and the light-reflecting layer 14 in a concentration such that the light reflected from the $D_{min}$ areas of the dye transfer image visually appears substantially white after aging.

The light-reflecting layer 14 preferably comprises a white pigment, particularly titanium dioxide. While only one layer 16 of silver halide emulsion is shown, it will be understood that in multicolor embodiments the silver halide emulsion "layer" 16 may comprise a plurality of silver halide emulsions (blue-, green- and red-sensitive) arranged in overlying planar relationship or in side-by-side or screen-like arrangement as is well known in the art. An image dye-providing material associated with each of the silver halide emulsions, in the same layer or in a contiguous layer, provides an image dye or an intermediate for an image dye having a color complementary to the light by which the associated silver halide emulsion is exposable, as is well known in subtractive color processes.

It will be understood that the elements of the film may be superposed and comprise an integral film unit during photographic exposure, i.e., photoexposure being effected through the transparent support 20 as shown, for example, in the aforementioned U.S. Pat. No. 3,415,644. Alternatively, the image-receiving layer 12 and its transparent support 20 may be separated from the photosensitive layers during exposure, the resulting laminate 10 being formed by the superposing of the respective elements with a processing composition containing a light-reflecting pigment distributed therebetween, as described, for example, in the aforementioned U.S. Pat. No. 2,983,606.

If the film unit is to be processed outside of a dark chamber, i.e., if it is to be removed from the camera prior to image completion and while the film is still photosensitive, appropriate opacifying reagents and/or layers should be provided. A particulary useful opacifying system for film units providing integral prints of the type shown in FIG. 1 and in the aforementioned U.S. Pat. No. 3,415,644 utilizes a color dischargeable reagent, preferably a pH-sensitive optical filter agent or dye, as is described in detail in U.S. Pat. No. 3,647,437 issued Mar. 7, 1972 to Edwin H. Land. In film units adapted to provide a laminate of the type shown in FIG. 2, photoexposure is effected from the side opposite the side from which the image is viewed, and an appropriate opaque layer 22 is provided over the silver halide emulsion(s) layer 16. This may be done by distributing a processing composition providing an opaque layer 22, e.g., containing carbon black, between the photosensitive layer 16 and the transparent support 24. Alternatively, opaque layer 22 may be omitted and lightprotection provided by an opaque layer (not shown) superposed over the transparent support 24 or directly over the photosensitive layer 16 after exposure.

In the preferred film structures for obtaining integral negative-positive reflection prints of the type shown in FIG. 1, photoexposure is effected through the same transparent support 20 through which the final dye transfer image is viewed.

In the preferred film units for obtaining integral negative-positive reflection prints of the type shown in FIG. 2, photoexposure is effected through the transparent support 24 and an opaque layer 22 to protect the exposed silver halide from further exposure may be provided by including a light-absorbing opacifying agent, e.g., carbon black, in the processing composition which is distributed between the photosensitive layer 16 and a transparent support 24. In such film units, it may be desirable to include a preformed opaque layer (not shown), e.g., a dispersion of carbon black in a polymer permeable to the processing composition, between a preformed light-reflecting layer 14 and the silver halide emulsion(s) 16. These embodiments are shown and described in the aforementioned U.S. Pat. Nos. 3,594,164 and 3,594,165.

As noted above, the initial position as well as the final position of the optical whitening reagent should be in a layer or layers of the image-receiving component other than the transparent support. In a particularly preferred embodiment, film structures of the type shown in FIGS. 1 and 2 include a neutralizing layer (not shown) positioned between the dye image layer and transparent support 20, and preferably, also include an inert interlayer or spacer layer (not shown) disposed between the neutralizing layer and the dye image layer to control or "time" the pH reduction. In this embodiment, the optical whitening reagent selected may be included in the neutralizing layer and/or the spacer layer and/or the dye image-receiving layer. Preferably, the optical whitening reagent is a dye developer which may be incorporated in one or more of the aforementioned layers but preferably is initially disposed in the neutralizing layer. Any dye developer not remaining immobilized in the neutralizing layer is mordanted by the dye image-receiving layer and thereby retained in the image-receiving component of the film structure.

The image dye-providing materials which may be employed in such processes generally may be characterized as either (1) initially soluble or diffusible in the processing composition but are selectively rendered non-diffusible in an imagewise pattern as a function of development; or (2) initially insoluble or non-diffusible in the processing composition but which are selectively rendered diffusible or provide a diffusible product in an imagewise pattern as a function of development. These materials may be complete dyes or dye intermediates, e.g., color couplers. The requisite differential in mobility or solubility may, for example, be obtained by a chemical action such as a redox reaction or a coupling reaction.

As examples of initially soluble or diffusible materials and their application in color diffusion transfer, mention may be made of those disclosed, for example, in U.S. Pat. Nos. 2,774,668; 2,968,554; 2,983,606; 2,087,817; 3,185,567; 3,230,082; 3,345,163; and 3,443,943. As examples of initially non-diffusible materials and their use in color transfer systems, mention may be made of the materials and systems disclosed in U.S. Pat. Nos. 3,185,567; 3,443,939; 3,443,940; 3,227,550; and 3,227,552. Both types of image-dye providing substances and film units useful therewith also are discussed in the aforementioned U.S. Pat. No. 3,647,437 to which reference may be made.

In any of these systems, multicolor images are obtained by employing a film unit containing at least two selectively sensitized silver halide layers each having associated therewith an image dye-providing material exhibiting desired spectral absorption characteristics. The most commonly employed elements of this type are the so-called tripack structures employing a blue-, a green- and a red-sensitive silver halide layer having associated therewith, respectively, a yellow, a magenta and a cyan image dye-providing material, as disclosed in U.S. Pat. No. 3,345,163 issued Oct. 3, 1967 to Edwin H. Land and Howard G. Rogers.

A particularly useful system for forming color images by diffusion transfer is that described in U.S. Pat. No. 2,983,606, employing dye developers as the image dye-providing materials. In such systems, a photosensitive element comprising at least one silver halide layer having a dye developer associated therewith (in the same or in an adjacent layer) is developed by applying an aqueous alkaline processing composition. Exposed and developable silver halide is developed by the dye developer which in turn becomes oxidized to provide an oxidation product which is appreciably less diffusible than the unreacted dye developer, thereby providing an imagewise distribution of diffusible dye developer in terms of unexposed areas of the silver halide layer, which imagewise distribution is then transferred, at least in part, by diffusion, to a dyeable stratum to impart thereto a positive dye transfer image. Multicolor images may be obtained with a photosensitive element having two or more selectively sensitized silver halide layers and associated dye developers, a tripack structure of the type described above in various patents including the aforementioned U.S. Pat. Nos. 2,983,606 and 3,345,163 being especially suitable for accurate color recordation of original subject matter.

In such color diffusion transfer systems, color transfer images are obtained by exposing a photosensitive element, sometimes referred to as a "negative component", comprising at least a light-sensitive layer, e.g., a gelatino silver halide emulsion layer, having an image dye-providing material associated therewith in the same or in an adjacent layer, to form a developable image; developing this exposed element with a processing composition to form an imagewise distribution of a diffusible image dye-providing material; and transferring this imagewise distribution, at least in part, by diffusion, to a superposed image-receiving component, sometimes referred to as a "positive component", comprising at least a dyeable stratum to provide a color transfer image. The negative and positive components initially may be carried on separate supports which are brought together during processing and thereafter retained together as the final integral negative-positive reflection print, or they may initially comprise a unitary structure, e.g., integral negative-positive film units wherein the negative and positive components are part of a photosensitive laminate or they may otherwise be physically retained together in superposed relationship prior to, during and after image formation. (Procedures for forming such film units wherein the positive and negative components are temporarily laminated together prior to exposure are described, for example in U.S. Pat. No. 3.652.281 to Albert J. Bachelder and Frederick J. Binda and in U.S. Pat. No. 3,652,282 to Edwin H. Land, both issued Mar. 28, 1972.) In either instance, the positive component is not removed from the negative component for viewing purposes. The preferred film units comprise a plurality of essential layers including a negative component comprising at least one light-sensitive silver halide and associated dye image-providing material and a positive component comprising a dyeable stratum. These components may be laminated together or otherwise secured together in physical juxtaposition as an essentially integral structure. Film units intended to provide multicolor images comprise two or more selectively sensitized silver halide layers each having associated therewith an appropriate image dye-providing material providing an image dye spectral absorption characteristics substantially complementary to the light by which the associated silver halide is exposed. The most commonly employed negative components for forming multicolor images are of the tripack structure and contain blue-, green- and red-sensitive silver halide layers each having associated therewith in the same or in a contiguous layer a yellow, a magenta and a cyan image dye-providing material respectively. Interlayers or spacer layers may, if desired, be provided between the respective silver halide layers and associated image dye-providing materials or between other layers. In addition to the aforementioned essential layers, such film units further include means for providing a reflecting layer between the dyeable stratum and the negative component in order to mask effectively the silver image or images formed as a function of development of the silver halide layer or layers and also to mask image dye-providing material which is not transferred, thereby providing a background, preferably white, for viewing the color image formed in the dyeable stratum, without separation, by reflected light. This reflecting layer may comprise a preformed layer of a reflecting agent included in the film unit or the reflecting agent may be provided after photoexposure, e.g., by including the reflecting agent in the processing composition. The dye transfer image is then viewable through a dimensionally stable protective layer or support. Most preferably another dimensionally stable layer or support, which may be transparent or opaque, is positioned on the opposed surface of the essential layers so that the aforementioned essential layers are between a pair of dimensionally stable layers or support members, one of which is transparent to permit viewing therethrough of the color transfer image. A rupturable container of known description contains the requisite processing composition and is adapted upon application of pressure to release its contents for development of the exposed film unit, e.g., by distributing the processing composition in a substantially uniform layer between a pair of predetermined layers. In film units providing an integral negative-positive reflection print of the type illustrated in FIG. 1, a processing composition containing a white pigment may be distributed between the dyeable stratum and the negative component to provide the light-reflecting layer 14.

A preferred opacification system to be contained in the processing composition to effect processing outside of a camera is that described in the above-mentioned U.S. Pat. No. 3,647,437, and comprises a dispersion of an inorganic light-reflecting pigment which also contains at least one light-absorbing agent, i.e., optical filter agent, at a pH above the pKa of the optical filter agent in a concentration effective when the processing composition is applied, to provide a layer exhibiting optical transmission density > than about 6.0 density units with respect to incident radiation actinic to the photosensitive silver halide and optical reflection density < than about 1.0 density units with respect to incident visible radiation.

In lieu of having the light-reflecting pigment in the processing composition, the light-reflecting pigment used to mask the photosensitive strata and to provide the requisite background for viewing the color transfer image formed in the receiving layer may be present initially in whole or in part as a preformed layer in the film unit. As an example of such a preformed layer, mention may be made of that disclosed in U.S. Pat. No. 3,615,421 issued Oct. 26, 1971 and in U.S. Pat. No. 3,620,724 issued Nov. 16, 1971, both in the name of Edwin H. Land. The reflecting agent may be generated in situ as is disclosed in U.S. Pat. Nos. 3,647,434 and 3,647,435, both issued Mar. 7, 1972 to Edwin H. Land.

The dye developers (or other image dye-providing substances) are preferably selected for their ability to provide colors that are useful in carrying out substractive color photography, that is, the previously mentioned cyan, magenta and yellow. They may be incorporated in the respective silver halide emulsion or, in the preferred embodiment, in a separate layer behind the respective silver halide emulsion. Thus a dye developer may, for example, be in a coating or layer behind the respective silver halide emulsion and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

The image-receiving layer may comprise one of the materials known in the art, such as polyvinyl alcohol, gelatin, etc. It may contain agents adapted to mordant or otherwise fix the transferred image dye(s). Preferred materials comprise polyvinyl alcohol or gelatin containing a dye mordant such as poly-4-vinylpyridine, as disclosed in U.S. Pat. No. 3,148,061, issued Sept. 8, 1964 to Howard C. Haas. If the color of the transferred image dye(s) is affected by changes in pH, the pH of the image layer may be adjusted to provide a pH affording the desired color.

As noted above, in the various color diffusion transfer systems which have previously been described and which employ an aqueous alkaline processing fluid, it is well known to employ an acid-reacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. No. 3,415,644 discloses systems wherein the desired pH reduction may be effected by providing a polymeric acid layer adjacent the dyeable stratum. These polymeric acids may be polymers which contain acid groups, e.g., carboxylic acid and sulfonic acid groups, which are capable of forming salts with alkali metals or with organic bases; or potentially acid-yielding groups such as anhydrides or lactones. Preferably the acid polymer contains free carboxyl groups. Alternatively, the acid-reflecting reagent may be in a layer adjacent the silver halide most distant from the image-receiving layer, as disclosed in U.S. Pat. No. 3,573,043 issued Mar. 30, 1971 to Edwin H. Land. Another system for providing an acid-reacting reagent is disclosed in U.S. Pat. No. 3,576,625 issued Apr. 27, 1971 to Edwin H. Land.

An inert interlayer or spacer layer may be and is preferably disposed between the polymeric acid layer and the dyeable stratum in order to control or time the pH reduction so that it is not premature and interfere with the development process. Suitable spacer or "timing" layers for this purpose are described with particularity in U.S. Pat. Nos. 3,362,819; 3,419,389; 3,421,893; 3,455,686; and 3,575,701.

While the acid layer and associated spacer layer are preferably contained in the positive component employed in systems wherein the dyeable stratum and photosensitive strata are contained on separate supports, e.g., between the support for the receiving element and the dyeable stratum; or associated with the dyeable stratum in those integral film units, e.g., on the side of the dyeable stratum opposed from the negative components, they may, if desired, be associated with the photosensitive strata, as is disclosed, for example, in U.S. Pat. Nos. 3,362,821 and 3,573,043. In film units such as those described in the aforementioned U.S. Pat. Nos. 3,594,164 and 3,594,165, they also may be contained on the spreader sheet employed to facilitate application of the processing fluid.

As is now well known and illustrated, for example, in the previously cited patents, the liquid processing composition referred to for effecting multicolor diffusion transfer processes comprises at least an aqueous solution of an alkaline material, for example sodium hydroxide, potassium hydroxide, and the like, and preferably possessing a pH in excess of 12, and most preferably includes a viscosity-increasing compound constituting a film-forming material of the type which, when the composition is spread and dried, forms a relatively firm and relatively stable film. The preferred film-forming materials disclosed comprise high molecular weight polymers such as polymeric, water-soluble ethers which are inert to an alkaline solution such as, for example, a hydroxyethyl cellulose or sodium carboxymethyl cellulose. Additionally, film-forming materials or thickening agents whose ability to increase viscosity is substantially unaffected if left in solution for a long period of time are so disclosed to be capable of utilization. As stated, the film-forming material is preferably contained in the processing composition in such suitable quantities as to impart to the composition a viscosity in excess of 100 cps. at a temperature of approximately 24° C. and preferably in the order of 100,000 cps. to 200,000 cps. at that temperature.

This invention will be further illustrated by the following example intended to be illustrative only.

EXAMPLE

A multicolor photosensitive element using, as the cyan, magenta and yellow dye developers cyan:

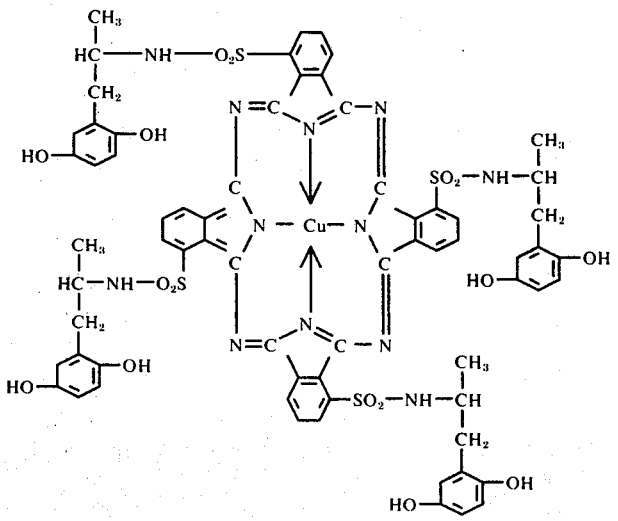

magenta:

-continued

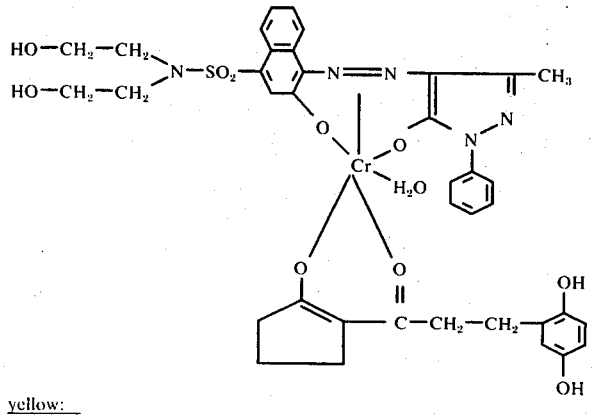

yellow:

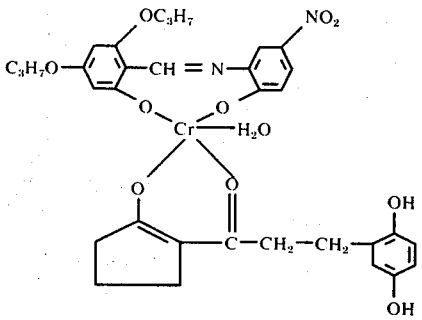

was prepared by coating a gelatin-subcoated 4 mil. opaque polyethylene teraphthalate film base with the following layers:

1. a layer of cyan dye developer dispersed in gelatin and coated at a coverage of about 100 mgs./ft.$^2$ of dye and about 80 mgs./ft.$^2$ of gelatin;

2. a red-sensitive gelatino silver iodobromide emulsion coated at a coverage of about 140 mgs./ft.$^2$ of silver and about 70 mgs./ft.$^2$ of gelatin;

3. a layer of a 60-30-4-6 copolymer of butylacrylate, diacetone acrylamide, styrene and methacrylic acid and polyacrylamide coated at a coverage of about 150 mgs./ft.$^2$ of the copolymer and about 5 mgs./ft.$^2$ of polyacrylamide;

4. a layer of magenta dye developer dispersed in gelatin and coated at a coverage of about 112 mgs./ft.$^2$ of dye and about 100 mgs./ft.$^2$ of gelatin;

5. a green-sensitive gelatino silver iodobromide emulsion coated at a coverage of about 100 mgs./ft.$^2$ of silver and about 50 mgs./ft.$^2$ of gelatin;

6. a layer containing the copolymer referred to above in layer 3 and polyacrylamide coated at a coverage of about 100 mgs./ft.$^2$ of copolymer and about 12 mgs./ft.$^2$ of polyacrylamide;

7. a layer of yellow dye developer dispersed in gelatin and coated at a coverage of about 70 mgs./ft.$^2$ of dye and about 56 mgs./ft.$^2$ of gelatin;

8. a blue-sensitive gelatino silver iodobromide emulsion layer including the auxiliary developer 4′-methylphenyl hydroquinone coated at a coverage of about 20 mgs./ft.$^2$ of silver, about 60 mgs./ft.$^2$ of gelatin and about 30 mgs./ft.$^2$ of auxiliary developer; and 9. a layer of gelatin coated at a coverage of about 50 mgs./ft.$^2$ of gelatin.

A transparent 4 mil. polyethylene terephthalate film base was coated, in succession, with the following layers to form an image-receiving component:

1. as a polymeric acid layer containing optical whitening reagent, the partial butyl ester of polyethylene/maleic anhydride copolymer at a coverage of about 2,500 mgs./ft.$^2$ containing 0.5 mg./ft.$^2$ each of the cyan and magenta dye developers set out in the foregoing structural formulas;

2. a timing layer containing about a 40:1 ratio of a 60-30-4-6 copolymer of butylacrylate, diacetone acrylamide, styrene and methacrylic acid and polyacrylamide at a coverage of about 500 mgs./ft.$^2$; and 3. a polymeric image-receiving layer containing a 2:1 mixture, by weight, of polyvinyl alcohol and poly-4-vinylpyridine, at a coverage of about 300 mgs./ft.$^2$. The two components thus prepared were then taped together, in laminate form, at their respective edges to provide an integral film unit, with a rupturable container retaining on aqueous alkaline processing solution fixedly mounted on the leading edge of each of the components, by pressure-sensitive tapes, so that, upon application of compressive pressure to the container to rupture the container's marginal seal, its contents were distributed in a layer approximately 0.0026 inch thick between the image-receiving layer and the gelatin overcoat layer of the photosensitive component.

The aqueous alkaline processing composition employed in the rupturable container was substantially similar to that described in Example 3 of the copending application of Edwin H. Land, Ser. No. 383,195 filed July 27, 1973.

The unitary film structure was totally exposed, i.e., exposed overall to incident actinic radiation and then developed by applying compressive pressure to the rupturable container in order to distribute the aqueous alkaline processing composition. Without separating the superposed photosensitive and image-receiving components, the integral densities were measured by reflectance through the transparent support layer of the image-receiving component using red, green and blue filters to give the initial minimum reflection densities. The film unit was then stored at room temperature (about 20° C.), and the integral densities were measured again at certain intervals.

A control was prepared and tested as described above except that the mixture of cyan and magenta dye developers was omitted from the polymeric acid layer.

The integral optical reflection densities measured initially and after aging appear in tabular form below.

| | Transfer Densities | | |
|---|---|---|---|
| Control | Red | Green | Blue |
| Initial | 0.15 | 0.17 | 0.25 |
| 17 hours | 0.16 | 0.18 | 0.26 |
| 36 hours | 0.14 | 0.17 | 0.26 |
| 5 days | 0.14 | 0.17 | 0.26 |
| 7 days | 0.15 | 0.18 | 0.27 |
| 8 days | 0.14 | 0.17 | 0.27 |
| Example | | | |
| Initial | 0.21 | 0.24 | 0.25 |
| 17 hours | 0.21 | 0.25 | 0.26 |
| 36 hours | 0.19 | 0.23 | 0.26 |
| 5 days | 0.20 | 0.24 | 0.27 |
| 7 days | 0.20 | 0.24 | 0.28 |
| 8 days | 0.20 | 0.24 | 0.28 |

As visually observed, the reflection print representing the control appeared yellow after aging. However, the reflection print prepared using the film unit containing the mixture of cyan and magenta dye developers in the neutralizing layer appeared substantially white to the eye after aging.

Another image-receiving element which gave beneficial results in rendering the highlight substantially white contained in the neutralizing layer 0.4 mg./ft.$^2$ and 0.6 mg./ft.$^2$, respectively, of the same magenta and cyan dye developers.

In view of the foregoing, it will be appreciated that the essence of the present invention resides in adding color, preferably in the form of dye developers positioned in the image-receiving component of composite film structures to achieve a balance between integral minimum reflection densities of the transfer image such that the build up of color stain in time is not visually discernible. In such film units where both exposure and viewing is made through the transparent support of the image-receiving component, the presence of dye developer(s) or other optical whitening reagent(s) does not interfere with photoexposure but enhances the quality of the color reflection print. As observed by the eye, the highlight areas of the transfer image appear substantially white after prolonged standing. Moreover, the subject method of balancing color stain is particularly efficient since the whitening reagent is retained in the image-receiving component of the film structure subsequent to processing and image formation. Thus, its effectiveness is not diminished in time by diffusing into or behind the light-reflecting layer which provides the white background for viewing the transfer image.

Where the optical whitening agent is a dye developer, the silver halide developer moiety thereof may also act as a reducing agent for stain-forming materials with which it is brought into reactive contact with. This property may be used also in system in which the image dyes are not dye developers.

It will be understood that dye transfer images which are neutral or black-and-white instead of multicolor may be obtained by use of a mixture of dyes of the appropriate colors, the transfer of which may be controlled by a single layer of silver halide, in accordance with known techniques. It is also to be understood that "direct positive" silver halide emulsions may also be used, depending upon the particular dye image-providing substances employed and whether a positive or negative color transfer image is desired.

Since certain changes may be made in the above produt and process without departing from the scope of the invention herein involved, it is intended that all matter contained in the above description or shown in the accompanying drawing shall be interpreted as illustrative and not in a limiting sense.

What is claimed is:

1. In a photographic film unit adapted for forming a color transfer image viewable as a reflection print including a photosensitive component comprising at least one light-sensitive silver halide layer having a dye image-providing material associated therewith, an image-receiving component including at least a dye image-receiving layer carried on a transparent support, and means for providing a reflecting layer between said photosensitive and image-receiving components in an amount sufficient after development of said film unit to mask effectively said photosensitive component and to provide a background for viewing a color transfer image by reflected light;

the improvement which comprises including in said film unit as a non-fluorescent optical whitening reagent a dye developer positioned initially in said image-receiving component in said dye image-receiving layer or a layer between said dye image-receiving layer and said transparent support and substantially non-diffusible from said image-receiving component, said whitening reagent being capable of absorbing visible light within a predetermined wavelength range complementary to the wavelength range absorbed by a colored stain formed during aging of said color transfer image and being present in a concentration such that the light reflected from the $D_{min}$ areas of said transfer image visually appears substantially white after aging.

2. A film unit as defined in claim 1 including a rupturable container releasably holding an aqueous alkaline processing composition.

3. A film unit as defined in claim 2 wherein said whitening reagent absorbs blue light and reflects red and green light.

4. A film unit as defined in claim 2 wherein said means for providing a reflecting layer comprises including a light-reflecting agent in said processing composition.

5. A film unit as defined in claim 2 wherein said image-receiving component contains a neutralizing layer composed of an acid-reacting reagent disposed between said dye image-receiving layer and said transparent support.

6. A film unit as defined in claim 1 wherein said whitening reagent is a cyan dye developer.

7. A film unit as defined in claim 1 wherein said whitening reagent is a mixture of cyan and magenta dye developers.

8. A film unit as defined in claim 5 wherein a timing layer is disposed between said dye image-receiving layer and said neutralizing layer.

9. A film unit as defined in claim 6 wherein said cyan dye developer has the formula:

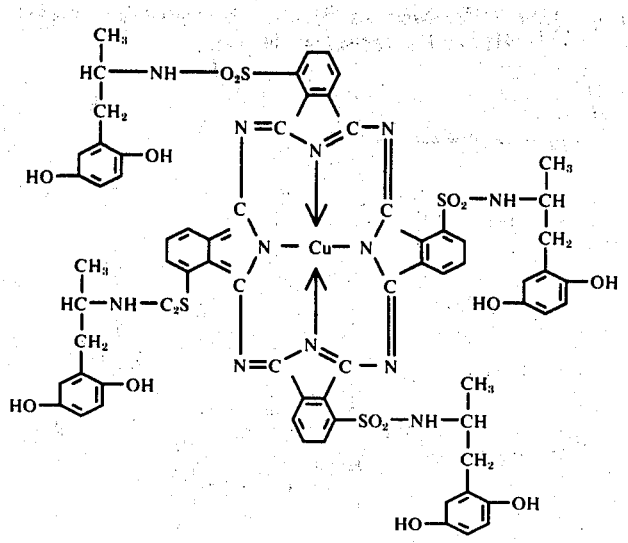

10. A film unit as defined in clam 7 wherein said magenta dye developer has the formula:

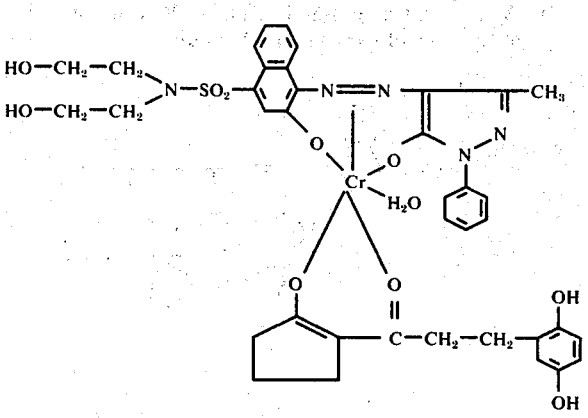

11. A film unit as defined in claim 5 wherein said dye developer is initially positioned in said neutralizing layer.

12. A film unit as defined in claim 2 wherein said photosensitive component includes an opaque support, a red-sensitive silver halide emulsion layer having a cyan dye image-providing material associated therewith, a green-sensitive silver halide emulsion layer having a magenta dye image-providing material associated therewith and a blue-sensitive silver halide emulsion layer having a yellow dye image-providing material associated therewith.

13. A film unit as defined in claim 12 wherein said dye image-providing materials are intially soluble and diffusible in said aqueous processing composition but are selectively rendered non-diffusible in an imagewise pattern as a function of development.

14. A film unit as defined in claim 13 wherein said aqueous alkaline processing composition includes at least one optical filter agent which is colored at the pH of said alkaline processing composition but which is capable of being rendered substantially colorless by lowering the pH of said processing composition subsequent to transfer image formation.

15. A film unit as defined in claim 14 wherein said means for providing a reflecting layer is titanium dioxide included in said processing composition.

16. A composite photographic film unit containing, as essential layers, in sequence, a dimensionally stable alkaline solution impermeable opaque layer, a layer containing a cyan dye developer, a red-sensitive gelatino silver halide emulsion layer, a layer containing a magenta dye developer, a green-sensitive gelatino silver halide emulsion layer, a layer containing a yellow dye developer, a blue-sensitive gelatino silver halide emulsion layer, a dyeable stratum, a neutralizing layer composed of an acid reacting reagent for effecting reduction of an alkaline processing composition having a first pH at which said dye developers are soluble and diffusible to a second pH at which said dye developers are substantially insoluble and non-diffusible, said neutralizing layer including as a non-fluorescent optical whitening reagent, a dye developer substantially uniformly distributed therein, a dimensionally stable alkaline solution impermeable transparent layer, means securing at least the side edges of said opposed layers in fixed relationship and a rupturable container releasably holding an aqueous alkaline processing composition having said first pH and containing dispersed therein a light-reflecting agent in a quantity sufficient to mask effectively said silver halide layers and any dye developer associated therewith after development and to provide a background for viewing a color diffusion transfer image formed by development of said film unit, by reflected light, through said transparent layer, said processing composition further including at least one optical filter agent which is highly colored at the pH of said processing composition whereby said film unit is capable, upon application of said processing composition, of being developed in the light, said rupturable container being fixedly positioned and extending transverse a leading edge of said photosensitive element so as to be capable of effecting unidirectional discharge of the container's contents between said dyeable stratum and said blue-sensitive silver halide emulsion layer upon application of compressive force to said container, said dye developer included as an optical whitening reagent in said neutralizing layer being capable of absorbing visible light within a predetermined wavelength range complementary to the wavelength range absorbed by a colored stain formed during aging of said color transfer image, said dye developer being present in a concentration such that the light reflected from the $D_{min}$ areas of said transfer image visually apears substantially white after aging.

17. A film unit as defined in claim 16 wherein said dye developer whitening reagent absorbs blue light and reflects red and green light.

18. A film unit as defined in claim 16 wherein said whitening reagent is a cyan dye developer.

19. A film unit as defined in claim 16 wherein said whitening reagent is a mixture of a cyan dye developer and a magenta dye developer.

20. A film unit as defined in claim 19 wherein said cyan dye developer has the formula

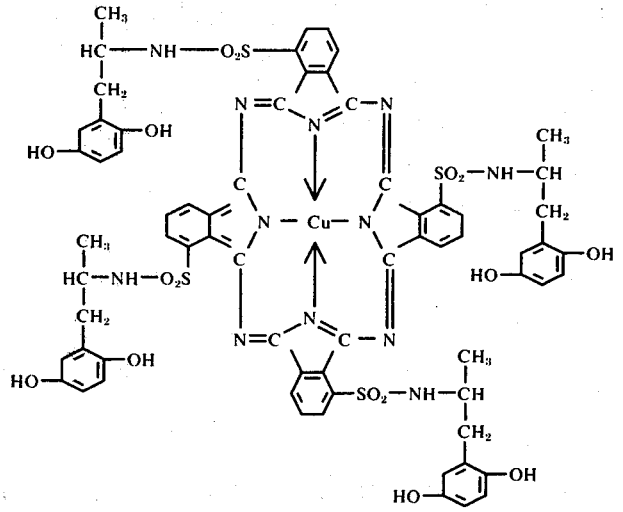

21. A film unit as defined in claim 20 wherein said magenta dye developer has the formula

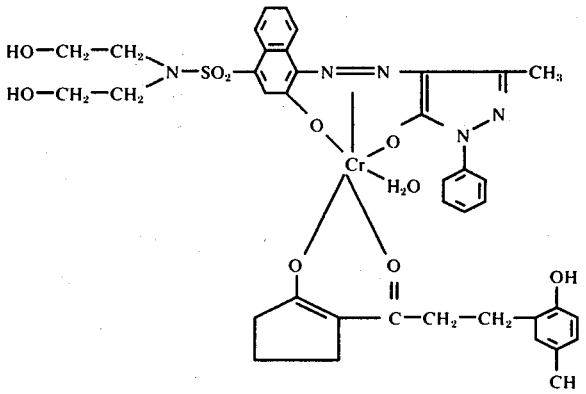

22. A film unit as defined in claim 21 wherein said neutralizing layer comprises a polymeric acid layer.

23. A process for providing a photographic diffusion transfer image which comprises, in combination, the steps of:

(a) exposing to incident actinic radiation a photographic film unit adapted for forming a color-transfer image viewable as a color reflection print including a photosensitive component comprising at least one light-sensitive silver halide layer having a dye image-providing material associated therewith, an image-receiving component including at least a dye image-receiving layer carried on a transparent support, a non-fluorescent optical whitening reagent disposed in said image-receiving component in said dye image-receiving layer or a layer between said dye image-receiving layer and said transparent support, said whitening reagent being a dye developer and being substantially non-diffusible from said image-receiving component, and means for providing a reflecting layer between said photosensitive and image-receiving components in an amount sufficient after development of said film unit to mask effectively said photosensitive component and to provide a background for viewing said color transfer image by reflected light;

(b) interposing a layer of a light-reflecting agent between said photosensitive component and said dye image-receiving layer;

(c) contacting the photoexposed silver halide layer with an aqueous alkaline processing composition;

(d) effecting thereby development of the photoexposed silver halide layer;

(e) forming thereby an imagewise distribution of diffusible dye image-providing material;

(f) transferring, by diffusion, at least a portion of the imagewise distribution of diffusible dye image-providing material to the dye image-receiving layer to impart a color transfer image thereto; and (g) maintaining said photosensitive and image-receiving components intact subsequent to transfer image formation, said whitening reagent in said image-receiving component being capable of absorbing visible light within a predetermined wavelength range complementary to the wavelength range absorbed by a colored stain formed during aging of said color transfer image, said whitening reagent being present in a concentration such that the light reflecting from the $D_{min}$ areas of said transfer image visually appears substantially white after aging.

24. A process as defined in claim 23 wherein said whitening reagent absorbs blue light and reflects red and green light.

25. A process as defined in claim 24 wherein said reflecting layer is interposed between said photosensitive and said image-receiving components by including a light-reflecting agent in said processing composition.

26. A process as defined in claim 23 wherein said whitening reagent is a cyan dye developer.

27. A process as defined in claim 23 wherein said whitening reagent is a mixture of a cyan dye developer and a magenta dye developer.

28. A process as defined in claim 27 wherein said cyan dye developer has the formula:

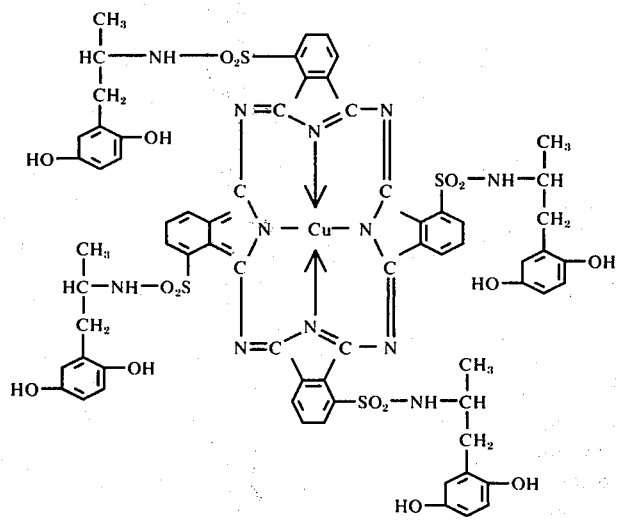

29. A process as defined in claim 28 wherein said magenta dye developer has the formula

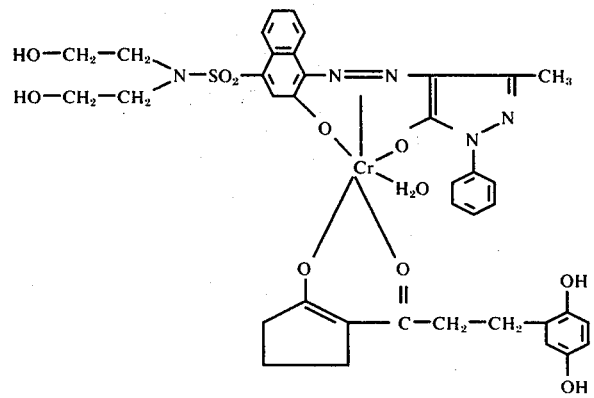

30. A process as defined in claim 29 wherein said image-receiving component contains a neutralizing layer composed of an acid-reacting reagent disposed between said dye image-receiving layer and said transparent support.

31. A process as defined in claim 30, wherein said photosensitive component includes a dimensionally stable opaque support layer, a red-sensitive silver halide emulsion layer having a cyan dye image providing material associated therewith, a green-sensitive silver halide emulsion layer having a magenta dye image-providing material associated therewith and a blue-sensitive silver halide emulsion layer having a yellow dye image-providing material associated therewith.

32. A process as defined in claim 31 wherein said dye image-providing materials are initially soluble and diffusible in said aqueous processing composition but are selectively rendered non-diffusible in an imagewise pattern as a function of development.

33. A process as defined in claim 32 wherein said aqueous alkaline processing composition additionally includes at least one optical filter agent which is colored at the pH of said alkaline processing composition but which is capable of being rendered substantially colorless by lowering the pH of said processing composition subsequent to transfer image formation.

34. A process as defined in claim 33 wherein said light-reflecting agent is titanium dioxide.

35. A process for providing a photographic diffusion transfer multicolor image viewable as a color reflection print which comprises, in combination, the steps of:

a. exposing to incident actinic radiation a photographic film unit which comprises a composite structure containing, as essential layers, in sequence, a dimensionally stable alkaline solution impermeable opaque layer; a red-sensitive silver halide emulsion layer having associated therewith cyan dye; a green-sensitive silver halide emulsion layer having associated therewith magenta dye; a blue-sensitive silver halide emulsion layer having associated therewith yellow dye, each of the cyan, magenta, and yellow dyes being silver halide developing agents and being soluble and diffusible, in alkali, at a first pH; an alkaline solution permeable and dyeable polymeric layer; a polymeric neutralizing layer containing sufficient acidifying capacity to effect reduction of a processing composition having the first pH at which the cyan, magenta and yellow dyes are soluble and diffusible to a second pH at which the dyes are substantially non-diffusible, said neutralizing layer including as an optical whitening reagent, a dye developer substantially uniformly distributed therein; a dimensionally stable alkaline solution impermeable transparent layer; and means securing said layers in substantially fixed relationship; and a rupturable container releasably holding an aqueous alkaline processing composition having the first pH and containing substantially uniformly disposed therein a light-reflecting agent and at least one optical filter agent possessing a pKa below the first pH and above the second pH, the light-reflecting agent and optical filter agent together being present in a quantity sufficient, upon distribution of the aqueous alkaline processing composition between the dyeable polymeric layer and said blue-sensitive silver halide emulsion layer, to provide a layer exhibiting optical transmission density sufficient to absorb incident radiation actinic to the silver halide emulsion layers and the rupturable container being fixedly positioned and extending transverse a leading edge of said photosensitive element to effect upon application of compressive force unidirectional discharge of the container's aqueous alkaline processing composition possessing the first pH intermediate the dyeable polymeric layer and blue-sensitive silver halide emulsion layer;

b. applying compressive force to the rupturable container to effect unidirectional discharge of the container's aqueous alkaline processing composition intermediate the dyeable polymeric layer and the blue-sensitive silver halide layer;

c. effecting thereby development of the red-, green- and blue-sensitive silver halide emulsion;

d. immobilizing the cyan, magenta and yellow dyes as a result of development of their associated silver halide emulsion;

e. forming thereby an imagewise distribution of diffusible cyan, magenta and yellow dye as a function of the point-to-point degree of exposure of their associated silver halide emulsion;

f. transferring, by diffusion, at least a portion of each of the imagewise distributions of diffusible cyan, magenta and yellow dye to the alkaline solution permeable polymeric layer dyeable by said dyes to impart thereto a multi-color dye image;

g. transferring, by diffusion, subsequent to substantial dye transfer, a sufficient portion of the ions of the aqueous alkaline processing composition to the polymeric neutralizing layer to thereby reduce the alkalinity of the composition from the first pH, above the pKa of the optical filter agent, at which the cyan, magenta and yellow image dyes are soluble and diffusible to a second pH, below the pKa of the optical filter agent, at which the cyan, magenta and yellow image dyes are substantially non-diffusible; and h. maintaining the composite structure intact subsequent to processing, said dye developer whitening reagent in said neutralizing layer being capable of absorbing visible light within a predetermined wavelength range complementary to the wavelength range absorbed by a colored stain formed during aging of said multi-color transfer image, said dye developer being present in a concentration such that the light reflected from the $D_{min}$ areas of said transfer image visually appears substantially white initially after aging.

36. A process as defined in claim 35 wherein said light-reflecting agent is titanium dioxide.

37. A process as defined in claim 36 wherein said dye developer whitening reagent absorbs blue light and reflects red and green light.

38. A process as defined in claim 37 wherein said whitening reagent is a cyan dye developer.

39. A process as defined in claim 37 wherein said whitening reagent is a mixture of a cyan dye developer and a magenta dye developer.

40. A process as defined in claim 39 wherein said cyan dye developer has the formula:

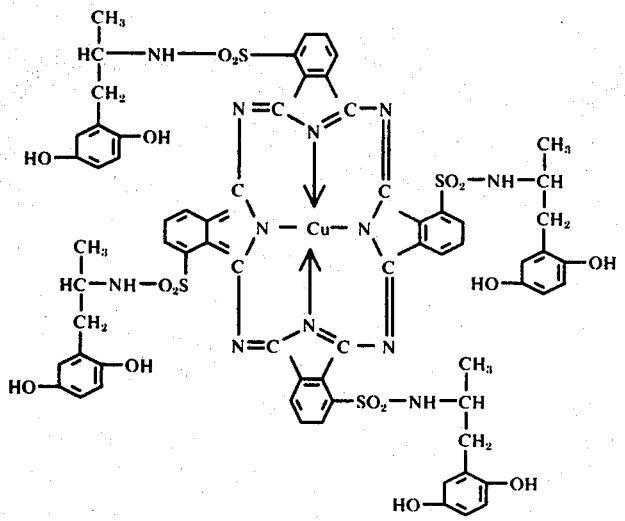
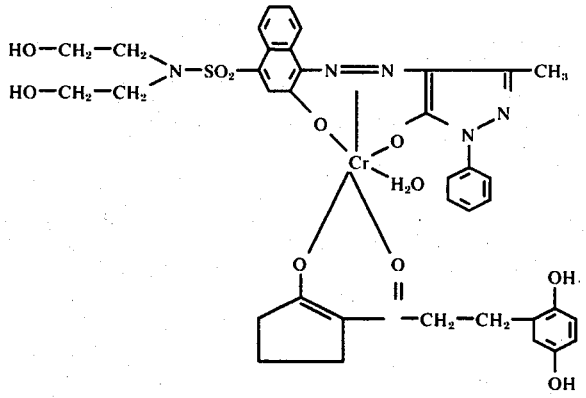
* * * * *
41. A process as defined in claim 40 wherein said magenta dye developer has the formula: